US006572438B2

(12) United States Patent
Numoto

(10) Patent No.: US 6,572,438 B2
(45) Date of Patent: Jun. 3, 2003

(54) STRUCTURE OF POLISHING HEAD OF POLISHING APPARATUS

(75) Inventor: Minoru Numoto, Mitaka (JP)

(73) Assignee: Tokyo Seimitsu Co., Ltd., Tokyo (JP)

( * ) Notice: Subject to any disclaimer, the term of this patent is extended or adjusted under 35 U.S.C. 154(b) by 155 days.

(21) Appl. No.: 09/771,413

(22) Filed: Jan. 26, 2001

(65) Prior Publication Data

US 2001/0011003 A1 Aug. 2, 2001

(30) Foreign Application Priority Data

Feb. 1, 2000 (JP) ..... 2000-024082

(51) Int. Cl.[7] ..... B24B 7/00
(52) U.S. Cl. ..... 451/3; 451/288; 451/398
(58) Field of Search ..... 451/3, 41, 59, 451/63, 285–290, 397, 398

(56) References Cited

U.S. PATENT DOCUMENTS

| | | | | |
|---|---|---|---|---|
| 5,205,082 A | | 4/1993 | Shendon et al. | 51/283 R |
| 5,584,751 A | | 12/1996 | Kobayashi et al. | 451/288 |
| 5,964,653 A | * | 10/1999 | Perlov et al. | 451/285 |
| 5,993,302 A | * | 11/1999 | Chen et al. | 451/285 |
| 6,036,587 A | * | 3/2000 | Tolles et al. | 451/288 |
| 6,080,050 A | * | 6/2000 | Chen et al. | 451/288 |
| 6,106,378 A | * | 8/2000 | Perlov et al. | 451/288 |
| 6,132,298 A | * | 10/2000 | Zuniga et al. | 451/288 |
| 6,143,127 A | * | 11/2000 | Perlov et al. | 156/345.14 |
| 6,162,116 A | * | 12/2000 | Zuniga et al. | 451/285 |
| 6,165,058 A | * | 12/2000 | Zuniga et al. | 451/287 |
| 6,183,354 B1 | * | 2/2001 | Zuniga et al. | 451/285 |
| 6,210,255 B1 | * | 4/2001 | Zuniga et al. | 451/285 |
| 6,241,593 B1 | * | 6/2001 | Chen et al. | 451/288 |
| 6,244,942 B1 | * | 6/2001 | Zuniga | 451/288 |
| 6,277,009 B1 | * | 8/2001 | Chen et al. | 451/288 |
| 6,277,010 B1 | * | 8/2001 | Perlov et al. | 451/288 |
| 6,277,014 B1 | * | 8/2001 | Chen et al. | 451/287 |
| 6,358,121 B1 | * | 3/2002 | Zuniga | 451/388 |
| 6,358,129 B2 | * | 3/2002 | Dow | 451/285 |
| 6,386,955 B2 | * | 5/2002 | Zuniga et al. | 451/287 |
| 6,398,621 B1 | * | 6/2002 | Zuniga et al. | 451/288 |
| 6,431,968 B1 | * | 8/2002 | Chen et al. | 451/288 |

FOREIGN PATENT DOCUMENTS

| | | |
|---|---|---|
| CN | 344694 | 11/1998 |
| JP | 6-79618 | 3/1994 |
| JP | 8-229808 | 9/1996 |
| JP | 11-347918 | 12/1999 |

* cited by examiner

*Primary Examiner*—Joseph J. Hail, III
*Assistant Examiner*—David B. Thomas
(74) *Attorney, Agent, or Firm*—Christie, Parker & Hale, LLP

(57) ABSTRACT

A polishing head of a polishing apparatus of this invention has a structure in which an air blast port is formed in a lower surface of a carrier 20, and an upper outer peripheral portion 24 of the carrier is so formed as to protrude in a diametric direction, and is placed on a retainer ring 30 to thereby form a seal portion 25. The retainer ring clamps a peripheral edge of a rubber sheet in such a form as to cover the carrier. Consequently, an air chamber 61 is formed between the carrier lower surface and the rubber sheet, and an air pressure of this air chamber pushes a wafer W to a polishing cloth 2.

7 Claims, 3 Drawing Sheets

STRUCTURE OF POLISHING HEAD OF POLISHING APPARATUS

CROSS-REFERENCE TO RELATED APPLICATION

This application claims priority of Japan patent Application No. 2000-024082, filed on Feb. 1, 2000.

BACKGROUND OF THE INVENTION

1. Field of the Invention

This invention relates to a structure of a polishing head of a polishing apparatus of a semiconductor wafer by CMP (Chemical Mechanical Polishing) and, more particularly, to a structure of a polishing head floating on air while polishing a wafer.

2. Description of the Related Art

As processing of ICs has made progress in recent years, the formation of IC patterns in multiple layers has been conducted. In this case, the occurrence of surface unevenness is unavoidable to a certain extent. It has been customary to form, as such, a pattern of a next layer on a preceding layer. As the number of the layers increases, however, the widths of lines and the diameters of holes have become smaller. The smaller the dimension, the more difficult it becomes to form an excellent pattern with the result that defects are more likely to occur. Therefore, it has been customary to polish the surface of a preceding layer on which the pattern is formed, so as to planarize the surface, and then to form the pattern of a next layer. To polish a wafer during the formation process of the IC pattern, a wafer polishing apparatus (CMP apparatus) using a CMP method has been employed.

An ordinary wafer polishing apparatus includes a disc-like polishing table having a polishing pad bonded to a surface thereof, a plurality of wafer polishing heads for holding one of the surfaces of a wafer to be polished and bringing the other surface of the wafer into contact with the polishing pad, and a head driving mechanism for causing these wafer polishing heads to rotate relative to the polishing table. Polishing is conducted while a slurry of a polishing agent is supplied between the polishing pad and the wafer.

A mechanism in which a packing material (wafer bonding sheet) is bonded to a wafer-holding carrier on a carrier surface side to be pushed, and one of the surfaces of the wafer is bonded to, and held by, this packing material (Japanese Unexamined Patent Publication (Kokai) No. 8-229808), and a mechanism in which a resilient porometic polyurethane insert is bonded to a carrier and the wafer is bonded to, and held by, this insert (Japanese Unexamined Patent Publication (Kokai) No. 6-79618) are known as the wafer holding mechanism of the wafer polishing heads.

In the conventional wafer holding mechanisms described above, however, a so-called "packing sheet" must be bonded to the surface of the carrier. However, air bubbles are likely to develop when the packing sheet is bonded, and skill is necessary for the bonding work. Planarity of the packing sheet bonding surface of the carrier and variance of the thickness of the packing material affect a wafer-processing surface. Furthermore, the wafer polishing heads must be removed whenever the packing sheet is bonded.

To solve these problems, the applicant of the present invention previously proposed a wafer polishing apparatus in Japanese Patent Application No. 10-92030. This wafer polishing apparatus employs an air blast member disposed on the lower surface of a carrier idly supported inside a wafer holding head main body in such a manner as to be capable of moving up and down, for blowing air to the rear surface of the wafer to form a pressure fluid layer between the carrier and the wafer. The wafer is pushed to a polishing table through this pressure fluid layer and is held.

Nonetheless, this wafer holding mechanism of the wafer polishing apparatus is not yet free from the problem that the rear surface of the wafer is likely to come into direct contact with, and to be damaged by, a hard surface of the carrier during delivery of the wafer by adsorption and during its polishing.

Therefore, the applicant of the present invention further proposed a wafer polishing apparatus in Japanese Patent Application No. 11-128558. In this wafer polishing apparatus, a protective sheet is disposed on an outer surface of an air blast member on a lower surface of a carrier, and is used as an air bag that is inflated by air from the air blast member so as to push the wafer to a polishing pad.

In this air bag system, an exhaust port for the air remains constant. Therefore, when the air pressure inside the protective sheet becomes higher than the pushing force that pushes the carrier and a retainer ring, a force that tilts the carrier develops if the point of receiving a lateral force exists above the surface of the polishing pad during processing, and this force affects processing accuracy. In addition, a variation in the thickness of the surface shape of the sheet affects processing accuracy, too.

SUMMARY OF THE INVENTION

It is an object of the present invention to provide a structure of a polishing head of a wafer polishing apparatus that completely inhibits jump-out of a wafer from inside a polishing head during polishing, and also inhibits undulation of a polishing pad and variance of thickness of a packing material (rubber sheet) from affecting planarization accuracy.

In a structure of a polishing head of a wafer polishing apparatus according to the present invention, a rubber sheet is disposed on an inner surface of a retainer ring, an air bag is formed by air from an air blast port of a carrier, and an upper outer peripheral edge of a carrier, that protrudes from the carrier, is placed on the retainer ring to form a seal portion of air. Therefore, even when a retainer pressure for pushing the retainer ring to the polishing pad is set to a low pressure and an air bag pressure for pushing the wafer is set to a high pressure, the seal portion plays the role of a regulator valve and the carrier does not push the wafer out from the retainer ring. The pushing force of the wafer does not change against the lateral force during processing of the wafer. Furthermore, the wafer is not damaged by coming into contact with the hard surface of the carrier.

In a structure of a polishing head according to another embodiment of the present invention, a plurality of holes is formed in the rubber sheet. In this way, the wafer adsorption holding effect of the polishing head during transportation of the wafer can be improved, and air blown out from the holes of the rubber sheet pushes the wafer to the polishing pad during polishing. Therefore, variation of the thickness of the rubber sheet and undulation of the polishing pad do not affect processing accuracy of the wafer. Since the quantity of air blown out from the gap between the wafer and the rubber sheet is extremely small, aggregation of slurry does not occur.

In a structure of a polishing head according to still another embodiment of the present invention, an interconnection portion constituting a retainer ring and a retainer main body are connected to each other by a ring so that assembly and disassembly can be done easily.

In a structure of a polishing head according to still another embodiment of the present invention, an exchange portion constituting the retainer ring is removably fitted to the retainer main body and the rubber sheet is clamped between the exchange portion and the retainer main body. In consequence, the exchange portion that undergoes wear can be frequently exchanged, and the rubber sheet, too, can be exchanged easily.

In a structure of a polishing head according to still another embodiment of the present invention, a lower surface of the carrier is divided into a plurality of regions, and a second rubber sheet is further disposed so that an air bag can be formed in each of these regions. As a result, the wafer processing quantity can be changed depending on the regions.

The present invention may be more fully understood from the description of preferred embodiments of the invention set forth below, together with the accompanying drawings.

DESCRIPTION OF THE PREFERRED EMBODIMENTS

Figure 1:
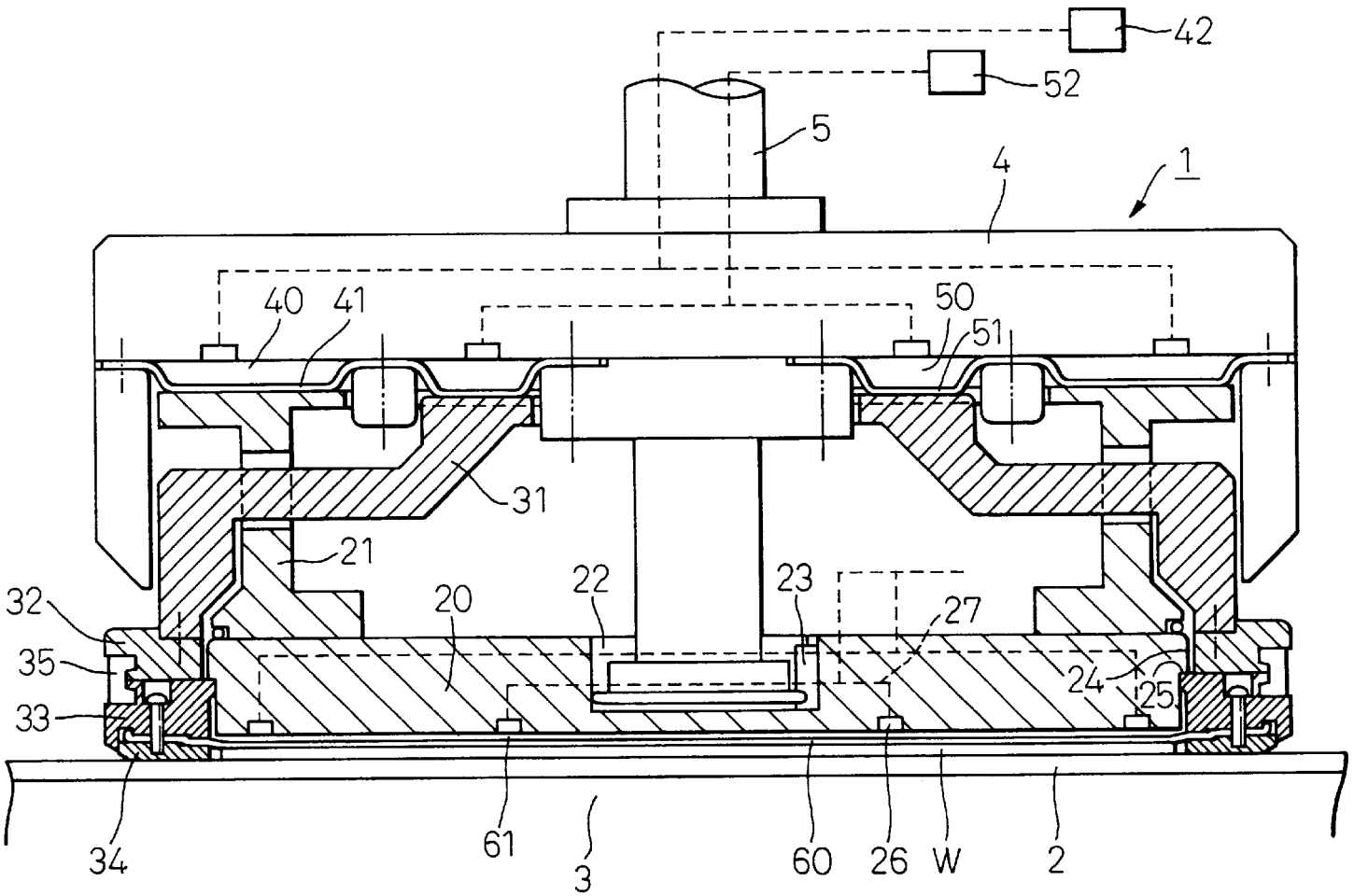
FIG. 1 is a longitudinal sectional view of a polishing head of a wafer polishing apparatus according to one embodiment of the present invention.

Hereinafter, structures of polishing heads of a wafer polishing apparatus according to preferred embodiments of the present invention are explained with reference to the accompanying drawings. FIG. 1 is a longitudinal sectional view of a polishing head 1 of a wafer polishing apparatus according to one embodiment of the present invention. The wafer polishing apparatus includes a polishing table 3 having a polishing pad 2 for polishing a wafer W, bonded to an upper surface thereof, and a polishing head 1 that holds and transports the wafer W onto the polishing table 3, releases holding of the wafer w at the time of polishing, pushes the wafer W to the polishing pad 2 at a predetermined polishing pressure by air and rotates the wafer W. The polishing table 3 further includes a rotation-driving unit, not shown, capable of relatively rotating the wafer w in a horizontal polishing direction with respect to the polishing head 1.

The polishing head 1 basically includes a carrier 20 for pushing the wafer W to the polishing pad 2, a retainer ring 30 shaped into a cylindrical shape, so disposed as to encompass the carrier 20 and to push the polishing pad 2 in the periphery of the wafer W, a head main body 4 disposed over the carrier 20 and the retainer ring 30, a driving unit 5 for rotating and driving the head main body 4, carrier push means 40 interposed between the head main body 4 and the carrier 20, for regulating the polishing pressure applied to the carrier 20, and retainer push means 50 interposed between the head main body 4 and the retainer ring 30, for applying the pushing force for pushing the polishing pad 2 to the retainer ring 30 and regulating the push force.

The carrier 20 has a carrier push member 21 that transfers the push force from the carrier push means 40 to the carrier 20. The retainer ring 30 similarly has a retainer push member 31 for transferring the push force from the retainer push means 50 to the retainer ring 30. These push members 21 and 31 are shown alternately disposed in FIG. 1, but they can be naturally disposed in such a manner as not to intersect one another, depending on the arrangement of the push means.

The carrier push means 40 is disposed at the outer peripheral portion of the lower surface of the head main body 4 and applies the push force to the carrier push member 21. In consequence, the push force is transmitted to the carrier 20 connected to the carrier push member 21 and pushes the wafer W to the polishing pad 2 through the carrier 20 as will be later explained. The carrier push means 40 preferably comprises an air bag 40 formed of a rubber sheet that expands and contracts when air is introduced and discharged. An air feed mechanism 42 for feeding air to the air bag 41 is interconnected to the carrier push means 40. The air feed mechanism 42 includes a regulator (not shown) for regulating the pressure of air that is pressure-fed from a pump.

The retainer push means 50 is disposed at the center of the lower surface of the head main body 4 and applies the push force to the retainer push member 31. In consequence, the push force is transmitted to the retainer ring 30 connected to the retainer push member 31, and the retainer ring 30 is pushed to the polishing pad 2. The retainer push means 50 preferably comprises an air bag of a rubber sheet in the same way as the carrier push means 40, and an air feed mechanism 52 for feeding air to the air bag 51 is interconnected to the carrier push means 51. The air feed mechanism 52, too, includes a regulator (not shown) for regulating the pressure of air that is pressure-fed from a pump.

A cylindrical recess 22 is defined at the center of the upper surface of the carrier 20. The shaft portion of the head main body 4 is fitted into the recess 22 of the carrier 20 and is fixed by a pin 23. Therefore, the carrier 20 can move up and down and can tilt to a certain extent. The upper outer peripheral portion 24 of the carrier 20 protrudes in a flange shape. When this upper outer peripheral portion 24 is placed on the upper surface of the retainer ring 30, they together form an air seal portion 25.

A hole or groove 26 for sucking and blowing out air is formed in the lower surface of the carrier 20. An air passage 27 is so formed as to communicate with this hole or groove 26. A suction pump and a feed air pump, not shown, that are connected to the air passage 27, are changeably used to suck/blast air. Incidentally, air is sucked when the wafer W is held and transported, and the blast of air releases its hold on the wafer at the time of polishing of the wafer W.

The retainer ring 30 comprises an interconnection portion 32, a retainer main body 33 and an exchange portion 34. The retainer ring 30 is interconnected to the retainer push member 31 at its interconnection portion 32 by a bolt, or the like. A ring 35, a part of which is cut off, couples the interconnection portion 32 and the retainer main body 33 so as to facilitate assembly and disassembly. A bolt, or the like, connects the retainer main body 33 and the exchange portion 34. Furthermore, the retainer main body 33 and the exchange portion 34 clamp the peripheral edge of the rubber sheet 60 in such a manner as to cover the carrier 20. In consequence, a gap between the lower surface of the carrier 20 and the rubber sheet 60 defines an air chamber 61 between them. This gap is optimally from about 0.5 to about 2 mm.

Therefore, the exchange portion 34 and the rubber sheet 60 can be easily exchanged, washed and repaired by removing the ring 35, the retainer main body 33, the exchange portion 34 and the rubber sheet 60 from the polishing head 1 and loosening the bolts.

Figure 3:
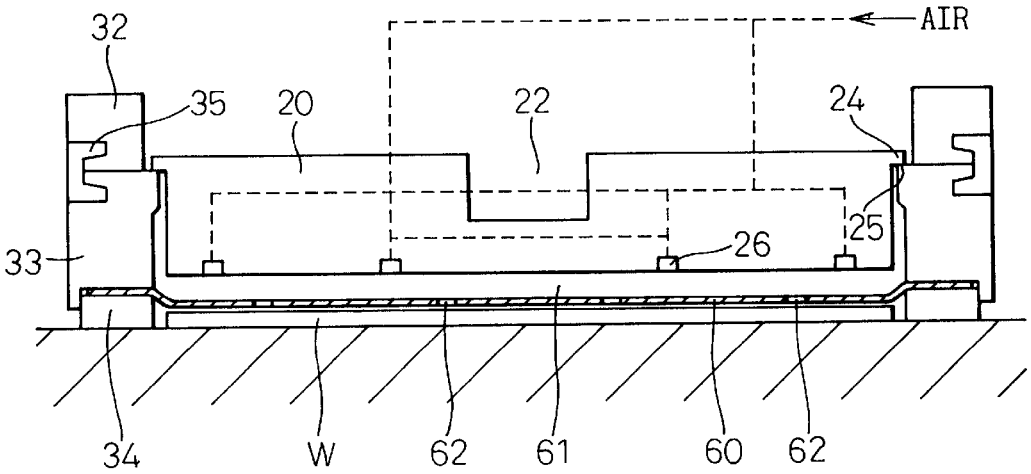
FIG. 3 is a partial enlarged view of a polishing head when a plurality of holes are formed in a rubber sheet in another embodiment of the present invention.

A plurality of holes 62 may be formed in the rubber sheet 60 as in another embodiment shown in FIG. 3. These holes function as adsorption holes when the polishing head 1 holds and transports the wafer W, and function as air blast holes when polishing is done. As air enters the gap between the rubber sheet 60 and the wafer W, it pushes the wafer W to the polishing pad 2.

It is also possible to form grooves, etc, on the contact surface of the rubber sheet 60 with the wafer W so that air can more easily push the wafer W. It is further possible to form ring-like protuberances on the contact surface of the rubber sheet 60 with the wafer W and to form concavities on the push surface of the rubber sheet 60.

Incidentally, even when the rubber sheet 60 has no hole 62, the wafer W can be held on the surface of the rubber sheet 60 as the polishing head 1 is pushed to the wafer W. In this case, air suction is not necessary.

Figure 2:
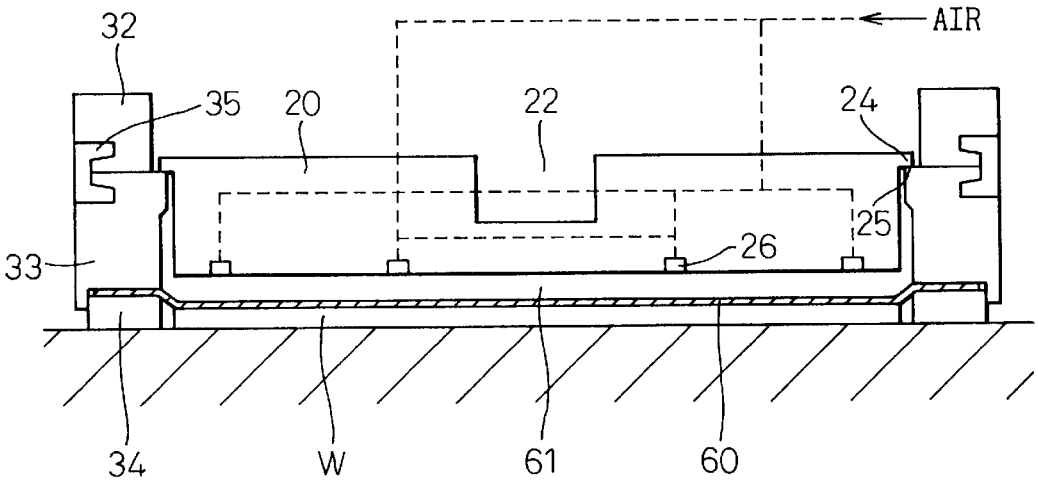
FIG. 2 is a partial enlarged sectional view of a polishing head when no hole exists in a rubber sheet in one embodiment of the present invention.

The partial enlarged view of FIG. 2 shows the polishing state of the wafer W using the polishing head 1 having the structure described above. When the upper outer peripheral portion 24 of the carrier 20 is completely put on the retainer ring 30, the force that pushes the wafer W to the polishing pad 2 is the air pressure inside the air chamber 61. As this air pressure rises and lifts up the carrier 20, the air inside the air chamber 61 is discharged from the seal portion 24, and the air pressure drops. The seal portion 25 plays in this way the role of a kind of a regulator valve and does not allow the air pressure inside the air chamber 61 to excessively increase. Therefore, jumping of the wafer W outside the polishing head 1 resulting from the drop of the pushing force of the retainer ring 30 to a level lower than the pushing force of the carrier 20, as observed in the prior art, can be prevented.

When the rubber sheet 60 has a plurality of holes 60 as in another embodiment of the present invention shown in FIG. 3, air inside the air chamber 61 enters the gap between the rubber sheet 60 and the wafer W, forming thereby a thin air layer and directly pushing the wafer W to the polishing pad 2. For this reason, any variance of the thickness of the rubber sheet 60 does not affect the surface processing accuracy of the wafer W. Since the quantity of air leaking from the gap of this air layer is extremely small, aggregation of the slurry does not occur. In this case, too, the air pressure inside the air chamber 61 is not allowed to excessively rise in the same way as described above, and jump-out of the wafer W can be prevented.

Even when the polishing head 1 receives a force in the lateral direction, the retainer ring 30 accepts this lateral force. Therefore, though this force functions as a lift-up force (tilting force) of the retainer ring 30, it does not affect the wafer W.

Figure 4:
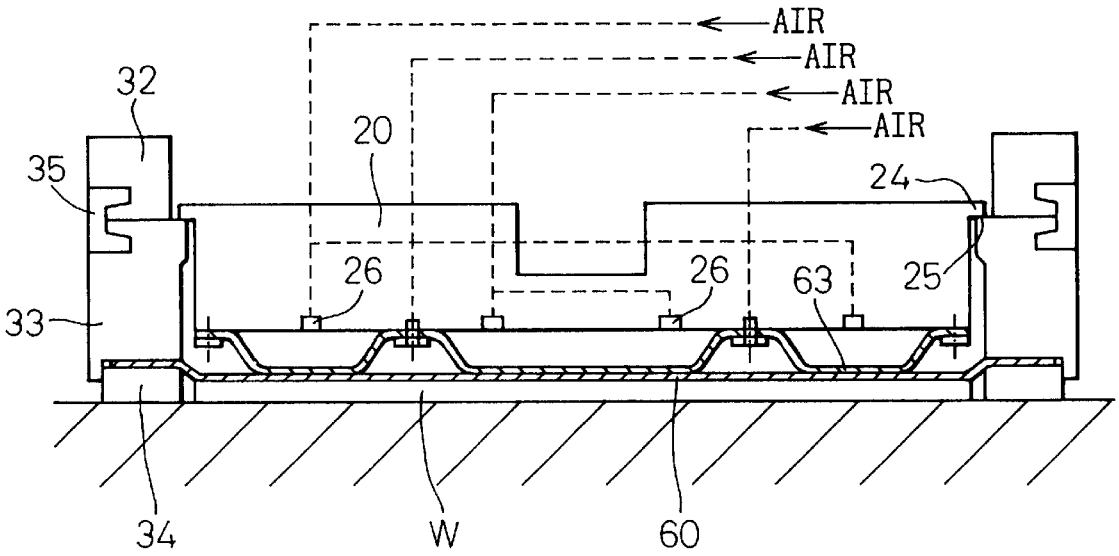
FIG. 4 is a partial enlarged sectional view of a polishing head when a second rubber sheet is further disposed in still another embodiment of the present invention.

The embodiments described above cannot change a processing quantity of the surface of the wafer W. As shown in FIG. 4, however, still another embodiment of the present invention divides the region of the lower surface of the carrier 20 into a plurality of regions such as the center portion and the outer peripheral portions, and disposes a second rubber sheet 63 in such a manner as to form the air bag in each of these regions. Accordingly, this embodiment can change the processing quantity. In this case, the air bag of each region has, quite naturally, an independent air feed passage.

In the structure of the polishing head of the wafer polishing apparatus according to the present invention described above, even when the wafer pushing force is set to a high level while the push force of the retainer ring is low, the wafer does not jump out from the polishing head, and the wafer push force does not change due to the lateral stress during polishing. The wafer is not affected by carrier surface accuracy, variance of the thickness of the rubber sheet material and dust on the push surface, and planarization polishing can be conducted with high accuracy. The exchange of the rubber sheet material and the exchange portion can be made easily, and the wafer processing quantity can be changed, too.

While the invention has been described with reference to specific embodiments chosen for purposes of illustration, it should be apparent that numerous modifications could be made thereto by those skilled in the art without departing from the basic concept and scope of the invention.

What is claimed is:

1. A structure of a polishing head of a polishing apparatus for pushing a work to a polishing pad on a polishing table and causing relative movement of said work, said polishing head including:

head main body allowed to rotate, and so disposed as to oppose said polishing table;

a carrier idly supported by said head main body in such a manner as to be capable of moving in a vertical direction;

a retainer ring idly supported by said head main body in such a manner as to be capable of moving in a vertical direction, encompassing said work and coming into contact with said polishing pad during polishing; and a flexible sheet supported at peripheral edge thereof by said retainer ring in such a manner as to cover the inside of said retainer ring to form a chamber between a first surface of said carrier and a first surface of said flexible sheet, and wherein a plurality of holes are formed in said flexible sheet;

wherein an outer peripheral edge portion of said carrier protruding in a diametric direction is placed on said retainer ring to form an air seal portion to maintain pressure in said chamber at or below a predetermined pressure level, and wherein, during polishing, air from an air blast port formed on said first surface of said carrier flows through said plurality of holes formed in said flexible sheet, inflates said flexible sheet and pushes said work to said polishing pad.

2. A structure of a polishing head of a polishing apparatus according to claim 1, wherein said retainer ring comprises an interconnection portion, a retainer main body and an exchange portion, and said interconnection portion and a retainer portion are coupled by a ring.

3. A structure of a polishing head of a polishing apparatus according to claim 1, wherein said retainer ring comprises an interconnection portion, a retainer main body and an exchange portion, and said interconnection portion and said retainer main body are coupled by a ring.

4. A structure of a polishing head of a polishing apparatus according to claim 2, wherein said exchange portion is removably fitted to said retainer main body, and the peripheral edge of said flexible sheet is clamped between said retainer main body and said exchange portion.

5. A structure of a polishing head of a polishing apparatus according to claim 3, wherein said exchange portion is removably fitted to said retainer main body, and the peripheral edge of said flexible sheet is clamped between said retainer main body and said exchange portion.

6. A structure of a polishing head of a polishing apparatus according to claim 1, wherein a lower surface of said carrier is divided into a plurality of regions, and a second flexible sheet is further disposed in such a manner as to form an air bag in each of said regions so formed.

7. A structure of a polishing head of a polishing apparatus for pushing a work to a polishing pad on a polishing table and causing relative movement of said work, said polishing head including:

head main body allowed to rotate, and so disposed as to oppose said polishing table;

a carrier idly supported by said head main body in such a manner as to be capable of moving in a vertical direction;

a retainer ring idly supported by said head main body in such a manner as to be capable of moving in a vertical direction, encompassing said work and coming into contact with said polishing pad during polishing; and a flexible sheet supported at peripheral edge thereof by said retainer ring in such a manner as to cover the inside of said retainer ring to form a chamber between a first surface of said carrier and a first surface of said flexible sheet, and wherein a plurality of holes are formed in said flexible sheet;

wherein an outer peripheral edge portion of said carrier protruding in a diametric direction is placed on said retainer ring to form an air seal portion to maintain pressure in said chamber at or below a predetermined pressure level, and wherein said plurality of holes are of sufficient size to permit air from an air blast port formed on said first surface of said carrier to flow there through during polishing.

* * * * *